US012221316B2

(12) United States Patent
Petersson et al.

(10) Patent No.: US 12,221,316 B2
(45) Date of Patent: Feb. 11, 2025

(54) METHOD AND SYSTEM FOR WINDING A CONTINUOUS ELONGATE ELEMENT

(71) Applicant: Fila Group AB, Anderstorp (SE)

(72) Inventors: Mats Petersson, Andertorp (SE); Jonas Blomqvist, Gislaved (SE); Christian Hiljemark, Halmstad (SE); Anders Gaardsdal, Gislaved (SE)

(73) Assignee: FILA GROUP AB, Anderstorp (SE)

( * ) Notice: Subject to any disclaimer, the term of this patent is extended or adjusted under 35 U.S.C. 154(b) by 520 days.

(21) Appl. No.: 17/690,172

(22) Filed: Mar. 9, 2022

(65) Prior Publication Data

US 2022/0289515 A1 Sep. 15, 2022

(30) Foreign Application Priority Data

Mar. 11, 2021 (EP) ..... 21162123

(51) Int. Cl.
*B65H 67/056* (2006.01)
*B65H 54/20* (2006.01)
(Continued)

(52) U.S. Cl.
CPC ..... *B65H 67/056* (2013.01); *B65H 54/205* (2013.01); *B65H 54/54* (2013.01); *B65H 54/71* (2013.01)

(58) Field of Classification Search
CPC .... B65H 67/056; B65H 54/205; B65H 54/54; B65H 54/71
See application file for complete search history.

(56) References Cited

U.S. PATENT DOCUMENTS 2,735,629 A * 2/1956 Hicks ..... B65H 67/056 24/DIG. 60
2,902,230 A 9/1959 Frank
(Continued)

FOREIGN PATENT DOCUMENTS

CH 591385 A * 9/1977 ..... B65H 54/54
CH 591385 A5 9/1977

OTHER PUBLICATIONS

European Search Report for European Application No. 21162123.0 dated Aug. 16, 2021.

*Primary Examiner* — Sang K Kim
*Assistant Examiner* — Nathaniel L Adams
(74) *Attorney, Agent, or Firm* — Buchanan Ingersoll & Rooney PC

(57) ABSTRACT

A method and a system of winding a continuous elongate element onto cylindrical elements. The continuous elongate element is wound from a feeder onto a first cylindrical element. The first cylindrical element rotates with the same rotational speed as a second cylindrical element provided on the other side of a central rotatable member. During the rotation, the feeder is displaced from being aligned with the first cylindrical element to being aligned with the second cylindrical element, wherein the displacement causes the continuous elongate element to come into engagement with an engagement portion of the central rotatable member, preventing the already wound portion of the continuous elongate element from being unwound from the first cylindrical element. The continuous elongate element from the feeder is continued to be wound onto the second cylindrical element by continuing to rotate the second cylindrical element.

13 Claims, 10 Drawing Sheets

(51) Int. Cl.
*B65H 54/54* (2006.01)
*B65H 54/71* (2006.01)

(56) References Cited

U.S. PATENT DOCUMENTS

| | | | | | |
|---|---|---|---|---|---|
| 3,051,403 | A * | 8/1962 | Johnson | B65H 67/056 | 242/475 |
| 3,080,128 | A * | 3/1963 | Hauer | B65H 67/056 | 242/474.9 |
| 3,368,765 | A * | 2/1968 | O'Grady | B65H 67/056 | 242/474.9 |
| 3,661,335 | A * | 5/1972 | Stefaniszyn | B65H 67/056 | 242/474.9 |
| 4,848,687 | A * | 7/1989 | Myers | B65H 67/056 | 242/474.9 |
| 2011/0215182 | A1 * | 9/2011 | Ryu | B65H 67/056 | 242/474.8 |

* cited by examiner

METHOD AND SYSTEM FOR WINDING A CONTINUOUS ELONGATE ELEMENT

TECHNICAL FIELD

The present disclosure relates to a method of winding a continuous elongate element, such as a wire cable, filament, thread or the like, onto cylindrical elements, such as spools, reels, mandrels or the like. The present disclosure also relates to a system for winding a continuous elongate element, such as a wire cable, filament, thread or the like, onto cylindrical elements, such as spools, reels, mandrels or the like.

BACKGROUND ART

Continuous elongate elements, such as wires, cables, filaments threads, etc. are commonly provided in a wound state. For instance, this may be cupper wires for electronic or constructional applications, plastic filaments for 3D printing applications, and of course many other implementations in which it is practical to provide a continuous elongate element in a wound state.

The continuous elongate element can be provided as a coil without any central support, or be supported by a spool or reel, etc. During production, in the case of a coil, the continuous elongate element is initially wound around a mandrel which is subsequently removed. Irrespective of if the continuous elongate element is to be wound around a spool, a reel or a mandrel or any other type of cylindrical element, the production process should suitably be a continuous production process. When the winding of the continuous elongate element onto the cylindrical element has been completed, it should then be winded onto the next cylindrical element, and so on. The switching between cylindrical elements may be time consuming.

In today's production processes for winding a continuous elongate element onto cylindrical elements you normally need to stop some of the equipment at the time of switching to a new and empty cylindrical element. This means that during winding production of the continuous elongate element, which is done at a constant speed, the continuous elongate element needs to be received by an accumulator during switching of cylindrical elements. The higher the production speed and the longer time needed for switching cylindrical elements, the longer portion of the continuous elongate element needs to be accumulated. This leads to the accumulator holding a large portion of the continuous elongate element and the accumulator needs to be very large and requires much space. When the switch is completed, the continuous elongate element needs to be winded onto the new cylindrical element at a much higher speed than the production/feeding speed in order to reduce the length of the continuous elongate element in the accumulator before the next switch occurs. Thus, the rotation of the new cylindrical element needs to be accelerated and be driven at very high speed to make the process work.

It would be desirable to provide an improved method and a system which mitigates at least some of the drawbacks of the prior art.

SUMMARY OF THE INVENTION

An object of the present disclosure is to provide a method and a system which mitigates at least some of the drawbacks of the prior art. This and other objects, which will become apparent in the following, are accomplished by a method and a system as defined in the accompanying independent claims.

The present invention is based on the insight that an accumulator may be omitted if a new cylindrical element (which has not yet received the continuous elongate element) is allowed to rotate together with a cylindrical element onto which the continuous elongate element is being winded, and that at the time of switching, the continuous elongate element is engaged so that it does not become unwound from the completed cylindrical element. In particular, the inventors have realized that the two cylindrical elements may be provided on a respective side of a central rotatable member which has an engagement portion which catches the continuous elongate element as it is moved to be wound onto the new cylindrical element.

According to a first aspect of the present inventive concept, there is provided a method of winding a continuous elongate element, such as a wire, cable, filament, thread or the like, onto cylindrical elements, such as spools, reels, mandrels or the like, the method comprising:

- winding the continuous elongate element from a feeder onto a first cylindrical element by rotating the first cylindrical element,
- providing a second cylindrical element so that the first cylindrical element and the second cylindrical element are located on respective sides of a central rotatable member such that the first cylindrical element, the second cylindrical element and the central rotatable member have the same geometrical rotational axis and rotate with the same rotational speed,
- while the first cylindrical element, the second cylindrical element and the central rotatable member rotate, displacing the feeder from being aligned with the first cylindrical element to being aligned with the second cylindrical element, wherein the displacement causes the continuous elongate element to come into engagement with an engagement portion of the central rotatable member, preventing the already wound portion of the continuous elongate element from being unwound from the first cylindrical element, and
- winding the continuous elongate element from the feeder onto the second cylindrical element by continuing to rotate the second cylindrical element.

Thus, by this method, a continuous winding process is achievable which does not require an accumulator when switching between the first and the second cylinder. The switching is substantially instantaneous.

The central rotatable member may be provided in different conceivable configurations. For instance, it may be in the form of a plate or a disc. It does not necessarily have to be circular or substantially circular. It may, for instance be rectangular or even provided as an X-shape or with a central hub from which a plurality of spokes extend radially. Thus, the rotatable member may have any suitable shape as long as it has an engagement portion with which the continuous elongate element comes into engagement when the feeder is shifted from being aligned with the first cylindrical element to being aligned with the second cylindrical element.

The above mentioned displacement of the feeder may suitably be performed as a displacement in parallel with the above mentioned geometrical rotational axis. However, other displacement patterns are conceivable as long as the continuous elongate element comes into engagement with engagement portion of the central rotatable member. Furthermore, it should be noted that the feeder may while being aligned with one of the cylindrical elements be displaced back and forth along that cylindrical element so that the continuous elongate element is substantially evenly wound onto that cylindrical element, i.e. the thickness of the winding on the cylindrical element may thus be substantially even along the axial extension of the winding.

The feeder may be any suitable device or arrangement from which the continuous elongate element may be pulled onto the rotating cylindrical elements. It should be understood that the term "feeder" as used in this disclosure should not be construed as limited to a device which actually provides a force to the continuous elongate element for driving the continuous elongate onto the rotating cylindrical elements. Rather the term "feeder" should be understood as a device or arrangement from which the continuous elongate element can be provided to a cylindrical elements be it by a pushing force or pulling force or any other force for making the continuous elongate element to be continuously provided to the cylindrical element. In practice, the rotation of the cylindrical element may provide a pulling force, i.e. pulling the continuous elongate element from the feeder.

The continuous elongate element may be provided to the feeder in various different conceivable ways. For instance, the feeder may be receive the continuous elongate element as it is being produced, such as in a continuous extrusion manufacturing process. Another alternative is that the feeder receives the continuous elongate element from a storage.

The finished product may, for instance, be a spool or reel carrying a wound continuous elongate element portion. However, as mentioned above, the cylindrical element may be mandrel which is removed after the winding, thus leaving a coil of the continuous elongate element.

When the winding of the continuous elongate element onto the first cylindrical element is completed, it may be cut to provide an individual product of the winded continuous elongate element (either supported by the cylindrical element such as a spool, reel etc., or as a coil without an internal supporting core). This is reflected in at least the following exemplary embodiment.

Thus, according to at least one exemplary embodiment, the method comprises, when the continuous elongate element is being wound onto the second cylindrical element, cutting the continuous elongate element at its engagement with the engagement portion so as to split it into two portions, a first portion already wound onto the first cylindrical element and a second portion which is still being winded onto the second cylindrical element, and removing the first cylindrical element axially away from the second cylindrical element while the second cylindrical element is still rotating.

The cutting may suitably be achieved by means of a cutter having cutting blade, a shearer or any other suitable device or arrangement that can divide the continuous elongate element.

By removing the first cylindrical element, at the time when the second cylindrical element is still rotating, a continuous process is achievable since a third cylindrical element can be arranged at the previous location of the first cylindrical element, ready to receive the continuous elongate element which is currently being wound to the second cylindrical element. This is reflected in the following exemplary embodiment.

According to at least one exemplary embodiment, the method comprises, when the continuous elongate element is being wound onto the second cylindrical element, providing a third cylindrical element, at the previous winding position of the first cylindrical element, so that the second cylindrical element and the third cylindrical element are located on respective sides of the central rotatable member such that the second cylindrical element, the third cylindrical element and the central rotatable member have the same geometrical rotational axis and rotate with the same rotational speed, while the second cylindrical element, the third cylindrical element and the central rotatable member rotate, displacing the feeder in parallel with said axis from being aligned with the second cylindrical element to being aligned with the third cylindrical element, wherein the displacement causes the continuous elongate element to come into engagement with the engagement portion of the central rotatable member, preventing the already wound portion of the continuous elongate element from being unwound from the second cylindrical element, and winding the continuous elongate element from the feeder onto the third cylindrical element by continuing to rotate the third cylindrical element.

This process may thus be repeated back and forth on both sides of the central rotatable member by cutting loose the "completed" cylindrical element (or rather the continuous elongate element portion wound onto that cylindrical element), while the "non-completed" cylindrical element keeps receiving the continuous elongate element as it rotates, and then replace the "completed" cylindrical element with an empty element.

It should be understood that in the case of the method being used for providing a coil, then the same mandrel may be reused. Thus, it may suffice with one mandrel on either side of the central rotatable member, e.g. a first mandrel and a second mandrel. When the continuous elongate element has been wound onto one of the mandrels, say the first mandrel, and the feeder has been displaced such that the continuous elongate element is being wound onto the second mandrel, then after the cutting the of the continuous elongate element, the completed portion of the continuous elongate element may be separated from the first mandrel (thus providing a coil of the continuous elongate element portion) so that the first mandrel becomes ready to receive a new portion of the continuous elongate element when the feeder is eventually returned to become aligned with the first mandrel.

Below will be discussed a system according to a second aspect of the present inventive concept. It should be understood that the features and embodiments presented in the system of the second aspect may also be implemented in the embodiments of the method of the first aspect, and vice versa.

According to a second aspect of the present inventive concept, there is provided a system for winding a continuous elongate element, such as a wire, cable, filament, thread or the like, onto cylindrical elements, such as spools, reels, mandrels or the like, the system comprising:

a feeder from which the continuous elongate element is providable to cylindrical elements in consecutive order, a plurality of cylindrical elements for receiving and winding said continuous elongate element, a central rotatable member provided with an engagement portion, and a control unit, wherein the control unit is configured to:

align the feeder with a first cylindrical element of said plurality of cylindrical elements for winding the continuous elongate element onto the first cylindrical element by rotating the first cylindrical element, provide the first cylindrical element and a second cylindrical element of said plurality of cylindrical elements on respective sides of the central rotatable member along a common geometrical rotational axis, rotate the first cylindrical element, the second cylindrical element and the central rotatable member with the same rotational speed, while the first cylindrical element, the second cylindrical element and the central rotatable member rotate, cause the feeder to be displaced from being aligned with the first cylindrical element to being aligned with the second cylindrical element, wherein the displacement causes the continuous elongate element to come into engagement with the engagement portion of the central rotatable member, preventing the already wound portion of the continuous elongate element from being unwound from the first cylindrical element, and continue to rotate the second cylindrical element for winding the continuous elongate element from the feeder onto the second cylindrical element.

It should be understood that in some exemplary embodiments the plurality of cylindrical elements may be only two, for example in the case of the cylindrical elements being mandrels used for production of the coils of the continuous elongate element. In other exemplary embodiments, the plurality of cylindrical elements may suitably be a multitude administered from one or more storage and/or supply devices. For instance, empty cylindrical elements such as spools or reels may be stacked and sequentially fed to the central rotatable member when a previous spool/reel has been completed (i.e. winding finished) and removed from the central rotatable member. There may in some embodiments be a single stack for providing empty cylindrical elements to both sides of the central rotatable member, while in other embodiments there may be one stack for each side of the central rotatable member.

The control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where it includes a programmable device such as the microprocessor, microcontroller or programmable digital signal processor mentioned above, the processor may further include computer executable code that controls operation of the programmable device.

According to at least one exemplary embodiment, the control unit may be configured to receive input parameter values relating to dimensions of an individual cylindrical element of said plurality of cylindrical elements and/or relating to dimensions of the continuous elongate element, wherein the control unit is configured to, based on the received input parameter values, determine when to switch the winding of the continuous elongate element from the first cylindrical element to the second cylindrical element. For instance, an operator may provide information relating to the width of axial length of the windable surface of the cylindrical element. In the case of the cylindrical elements being spools having end walls, the radial extent thereof may be input, etc. Furthermore, it should be understood that the input parameter values do not necessarily need to be input manually, but may be automated, e.g. by the provision of a scanner, RFID, QR-codes, or any other suitable means which allows identification of dimensions or identification of the type of cylindrical element, the dimensions of which may be stored in a look-up table included in or accessible by the control unit.

The radial distance between the engagement portion of the central rotatable member and the common geometrical rotational axis should suitably be larger than the radial distance between the enveloping surface of the completed winding on a cylindrical element and the common geometrical rotational axis. In other words, the thickness of the winding should not be so large that it extends radially as far as the engagement portion of the central rotatable member. Hereby, unwinding of the continuous elongate element may be avoided. In the case of the cylindrical elements being in the form of spools or reels, the radial extension of the end wall portions of such spools or reels is suitably shorter (as seen from the common geometrical rotational axis) than the radial extension of said engagement portion. This is reflected in at least the following exemplary embodiment.

According to at least one exemplary embodiment, each cylindrical element comprises a cylindrical winding portion delimited by a wall portion at each end of the cylindrical winding portion, wherein, when the first cylindrical element, the second cylindrical element and the central rotatable member rotate around the common geometrical rotational axis, the radial distance between the common geometrical rotational axis and the engagement portion is larger than the radial distance between the common geometrical rotational axis and a circumference of said wall portions of the first and second cylindrical elements. Thus, by having a radially larger extension of the central rotatable member, unwinding may be avoided, while the continuous elongate element is started to be wound onto the next cylindrical element.

According to at least one exemplary embodiment, the engagement portion of the central rotatable member comprises a plurality of protrusions, such as tooth-like, hook-like or barb-like protrusions, wherein the plurality of protrusions present abutment surfaces for catching the continuous elongate element as the feeder is moved from being aligned with the first cylindrical element to being aligned with the second cylindrical element.

It should be understood that the engagement portion, for example protrusions thereof, have the function of providing a substantially fixed point for the continuous elongate element. In other words the point of the continuous elongate element that has come into engagement with the central rotatable member will be umovable (at least temporarily, such as until the continuous elongate element is cut) relative to the central rotating member the first cylindrical element and the second cylindrical element. Thus, that unmovable point will rotate with the same rotational speed as the other components. By having a point of the continuous elongate element unmovable relative to the portion (first) cylindrical element with its completed winding, there is no risk of continuous elongate element becoming unwinded. By having a point of the continuous elongate element unmovable relative to the (second) cylindrical element which starts to receive the continuous elongate element, the fixed point ensures that the continuous elongate element "gets a grip" around the cylindrical element during rotation thereof, as the continuous elongate element is continuously pulled from the feeder.

According to at least one exemplary embodiment, the system comprises a cutter, wherein the control unit is configured to control the cutter to cut the continuous elongate element at its engagement with the engagement portion so as to split it into two portions, a first portion already wound on the first cylindrical element and a second portion which is still being winded onto the second cylindrical element.

Suitably, the control unit is programmed such that the cutting is performed a certain period of time after the second cylindrical element has started to receive the continuous elongate element. In particular, the cutting is suitably performed, when the second cylindrical element has made a sufficient number of rotations for the continuous elongate element to become self-locking, i.e. so that the continuous elongate element has been sufficiently winded onto itself, to avoid the risk of unwinding after the cutting is performed.

There are various ways to achieve the cutting action. For instance, according to at least one exemplary embodiment, the central rotatable member comprises a circular slit extending along the periphery of the central rotatable member, wherein the circular slit is configured to receive the cutter for enabling the cutter to split the continuous elongate element into two portions. In other exemplary embodiments, the cutter may instead cut the continuous elongate element on the side of the central rotatable member.

According to at least one exemplary embodiment, the system comprises

- a first motor configured to drive a first rotatable shaft, the first rotatable shaft being configured to receive and hold a cylindrical element on one side of the central rotatable member,
- a second motor configured to drive a second rotatable shaft, the second rotatable shaft being configured to receive and hold a cylindrical element on the opposite side of the central rotatable member, wherein the control unit is configured to control the operation of the first and the second motors.

By having two separate motors which are individually controllable, the control unit may keep operating one of the motors for winding the continuous elongate element onto the cylindrical element that the motor is operatively connected to, while temporarily deactivating the other motor replacing a full cylindrical element or making the cylindrical element ready to receive a new portion of the continuous elongate element. The control unit may also synchronize the rotational speed of the motors for making a smooth transition when the feeder is displaced from being aligned with one of the cylindrical elements to becoming aligned with the other one.

Although the rotation of the central rotatable member may, in some exemplary embodiments be controlled by the control unit individually, such as by means of a third motor, a convenient solution is to let the rotation of the central rotatable member be controlled by the same motor that is currently rotating the cylindrical element onto which the continuous elongate element is currently being wound onto. This is at least partly reflected in the below exemplary embodiment.

According to at least one exemplary embodiment, the first rotatable shaft is provided with a first spindle which is displaceable along said geometrical rotational axis, the first spindle being provided with a first magnet, wherein the second rotatable shaft is provided with a second spindle which is displaceable along said geometrical rotational axis, the second spindle is provided with a second magnet, wherein the central rotatable member is provided with one or more magnetic portions, for magnetically connecting the central rotatable member to the first magnet and the second magnet to enable the central rotatable member to rotate with cylindrical elements held by the first and second rotatable shafts.

The first and second spindles (with their respective magnets) may suitably be retractable and advanceable within the respective rotatable shafts. Thus, even though a magnet is retracted, thus disconnecting it form the central rotatable member, the associated rotatable shaft may still hold the cylindrical element at the central rotatable member. Thus, the magnetic connection and the displacement of the cylindrical element may be individually controlled. In other words, the axial displacement of the spindle may be individually controlled relative to the axial displacement of the associated rotatable shaft. The first and second magnets may be of any suitable type, such as permanent magnets or electromagnets.

According to at least one exemplary embodiment, after the cutter has cut the continuous elongate element, the control unit is configured to disconnect the first magnet from said one or more magnetic portions of the central rotatable member and axially remove the first cylindrical element from the central rotatable member which continues to rotate with the second cylindrical element. Although maintaining the central rotatable member in place and in rotation provides an easy and smooth handling and removal of the first cylindrical element, it should be understood that other options are also conceivable. For instance, the central rotatable member could be removed together with the first cylindrical element, while the second cylindrical element continues to rotate for receiving the continuous elongate element. In such an option, the control unit would disconnect the second magnet from said one or more magnetic portions of the central rotatable member, while keeping the first magnet connected to the central rotatable member. When the first cylindrical element is returned (irrespective of which of the above alternatives, i.e. with or without the central rotatable member), or is replaced by a third cylindrical element, the control unit suitably initiates rotation of the this cylindrical element before it is brought into its location for receiving the continuous elongate element. More specifically, the control unit suitably makes sure that it arrives at the same rotational speed as the second cylindrical element which is currently receiving the continuous elongate element. Thus, at the time the three units (first cylindrical element, central rotatable member and the second cylindrical element) are brought together they may suitably already rotate at the same rotational speed.

As mentioned above, the cylindrical elements may be re-used (e.g. when being in the form of mandrels which will not form part of the end product for the wound continuous elongate element) or they may be replaced by new cylindrical elements. Thus, according to at least one exemplary embodiment, the control unit is configured to provide a third cylindrical element to the first rotatable shaft to arrange the third cylindrical element at the previous winding position of the first cylindrical element, so that the second cylindrical element and the third cylindrical element are located on respective sides of the central rotatable member such that the second cylindrical element, the third cylindrical element and the central rotatable member have the same geometrical rotational axis and rotate with the same rotational speed.

According to at least one exemplary embodiment, the control unit is configured to control the first and second motor in master-slave-synchronization mode in which the slave is synchronized with the rotational speed of the master, wherein at any given point in time, the one of the first and second motors that is operating a cylindrical element onto which the continuous elongate element is currently being winded is the master, while the other one of the first and second motors is the slave. This is beneficial as it provides a smooth operation of the system.

According to at least one exemplary embodiment, the system comprises at least one roller, wherein the control unit is configured to apply the at least one roller against the already winded portion of the continuous elongate element before the cutter cuts the continuous elongate element. By having a roller applied against the already winded portion of the continuous elongate element, the risk of it becoming unwinded when the cut has been made and the cylindrical element is still rotating, is reduced. Suitably, the roller is held against the winded portion until the cylindrical element has come to a complete rotational stop or has at least decelerated substantially. Suitably, the roller is held against the winded portion until the cut end of the continuous elongate element has been has been secured somehow, such as by means of a sticker, label, or any other suitable securing means.

Generally, all terms used in the claims are to be interpreted according to their ordinary meaning in the technical field, unless explicitly defined otherwise herein. All references to "a/an/the element, apparatus, component, unit, member, means, step, etc." are to be interpreted openly as referring to at least one instance of the element, apparatus, component, unit, member, means, step, etc., unless explicitly stated otherwise. The steps of any method disclosed herein do not have to be performed in the exact order disclosed, unless explicitly stated. Further features of, and advantages with, the present invention will become apparent when studying the appended claims and the following description. The skilled person realizes that different features of the present invention may be combined to create embodiments other than those described in the following, without departing from the scope of the present inventive concept.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
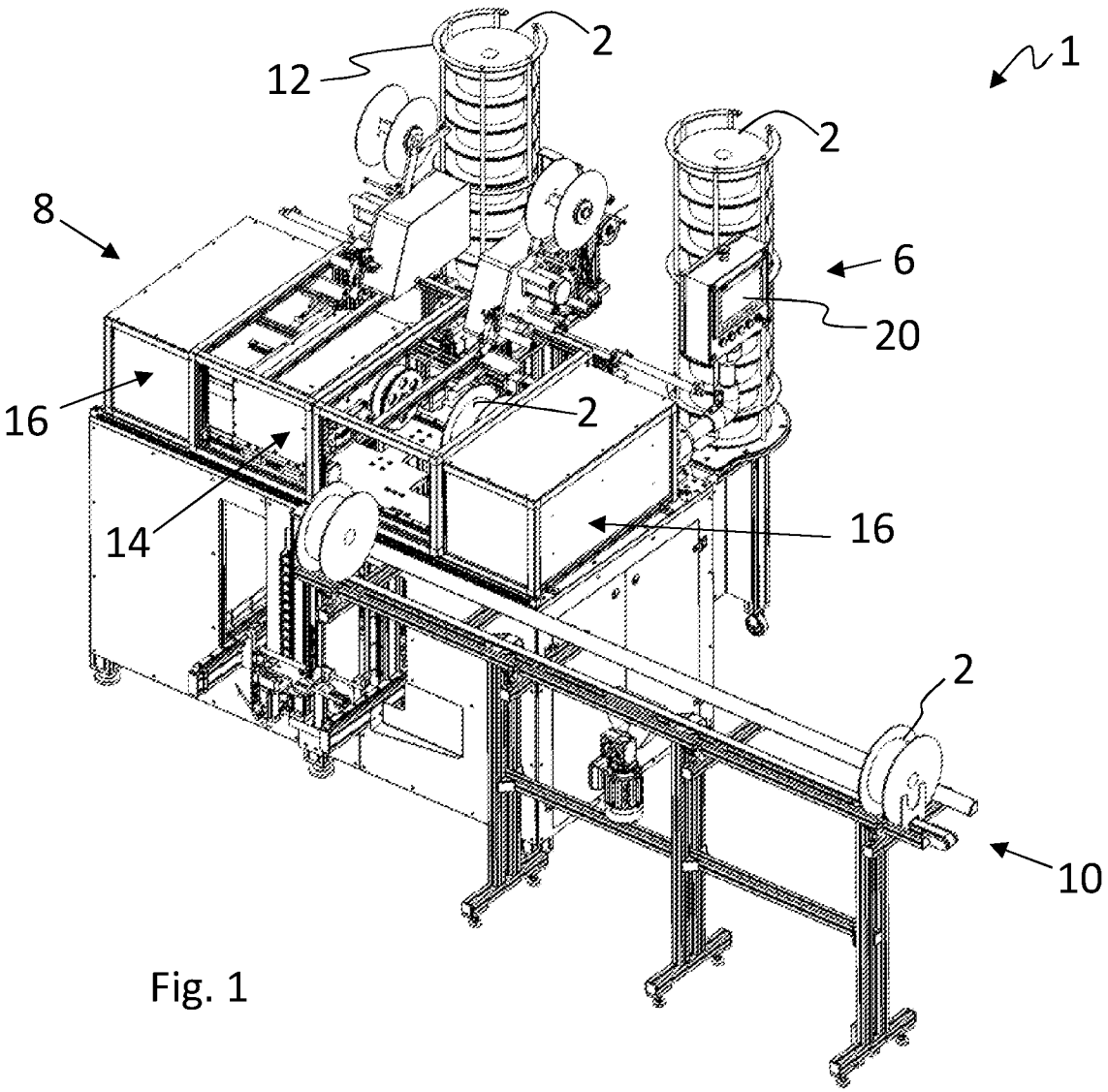
FIG. 1 illustrates a system according to at least one exemplary embodiment of the present invention.

The invention will now be described more fully hereinafter with reference to the accompanying drawings, in which certain aspects of the invention are shown. The invention may, however, be embodied in many different forms and should not be construed as limited to the embodiments and aspects set forth herein; rather, the embodiments are provided by way of example so that this disclosure will be thorough and complete, and will fully convey the scope of the invention to those skilled in the art. Accordingly, it is to be understood that the present invention is not limited to the embodiments described herein and illustrated in the drawings; rather, the skilled person will recognize that many changes and modifications may be made within the scope of the appended claims. Like reference numerals refer to like elements throughout the description.

FIG. 1 illustrates a system 1 according to at least one exemplary embodiment of the present invention. The system 1 comprises a plurality of cylindrical elements 2 onto which a continuous elongate element 4 is to be winded (see FIG. 8 and FIG. 9). Each cylindrical element 2 will thus receive a respective portion of the continuous elongate element 4. As explained previously in this disclosure, the cylindrical elements 2 may be of various different types. In this exemplary embodiment, the cylindrical elements 2 are illustrated in the form of spools. As also explained previously, the continuous elongate element 4 may be any suitable windable element, such as a filament, thread, wire, cable, etc.

As illustrated in FIG. 1, the system 1 may suitably comprise a pre-winding section 6, a winding section 8 and a post-winding section 10. The pre-winding section 6 may, for instance, comprise storage arrangements 12 for holding cylindrical elements 2 before they are provided in position for receiving the continuous elongate element 4. In this exemplary embodiment two storage arrangements 12 are illustrated, each one holding a respective stack of cylindrical elements 2 that are to be consecutively presented to the winding section 8. As discussed previously in this disclosure, in some exemplary embodiments, the cylindrical elements may be reused (e.g. when being in the form of mandrels that are temporarily expandable for receiving the continuous elongate element 4 to form a coil, and thereafter returning to a non-expanded state for releasing the finished coil). In such cases, the storage arrangements 12 may be omitted, if desired. It should, however, be understood that the storage arrangements 12 in FIG. 1 are just illustrating one example out of many conceivable examples. The pre-winding section 6 may thus provide the cylindrical elements 2 to the winding section 8 in numerous ways.

The winding section 8 is here illustrated as having a central part 14 and two side parts 16, which may be at least partly enclosed in a casing. The central part 14 of the winding section 8 is the location at which the cylindrical elements 2 are positioned when they receive the continuous elongate element 4, i.e. when the continuous elongated element 4 is winded onto a cylindrical element 2. The side parts 16 may include various actuating mechanisms, such as motors, for rotating and/or displacing the cylindrical elements 2. However, motors and other actuating mechanisms may also be located in the central part 14. Motors will be discussed in more detail below in connection with the discussion of other drawing figures.

The post-winding section 10, which in some embodiments may be omitted, may be of any suitable form for receiving the cylindrical elements 2 after they have been provided with the thereon winded continuous elongate element 4 (or for receiving winded coils without the cylindrical elements). The post-winding section 10 is here illustrated as including a receiving rail, however other receiver or means of transport (such as conveyors) are conceivable to include in the post-winding section 10. FIG. 1 merely presents a very general overview of the system 1, and therefore the cylindrical elements 2 at the post-winding section 10 are not illustrated as having received the continuous elongate element 4 (which, as mentioned previously is shown in FIG. 8 and FIG. 9).

As illustrated in FIG. 1, the system 1 comprises a control unit 20 configured to control the operation of the system 1. The control unit 20 may comprise or be operatively connected to a user interface, such as including a display, for providing information to an operator and/or for receiving input data from an operator. More detailed discussion of the control unit 20 will follow further below.

Figure 2:
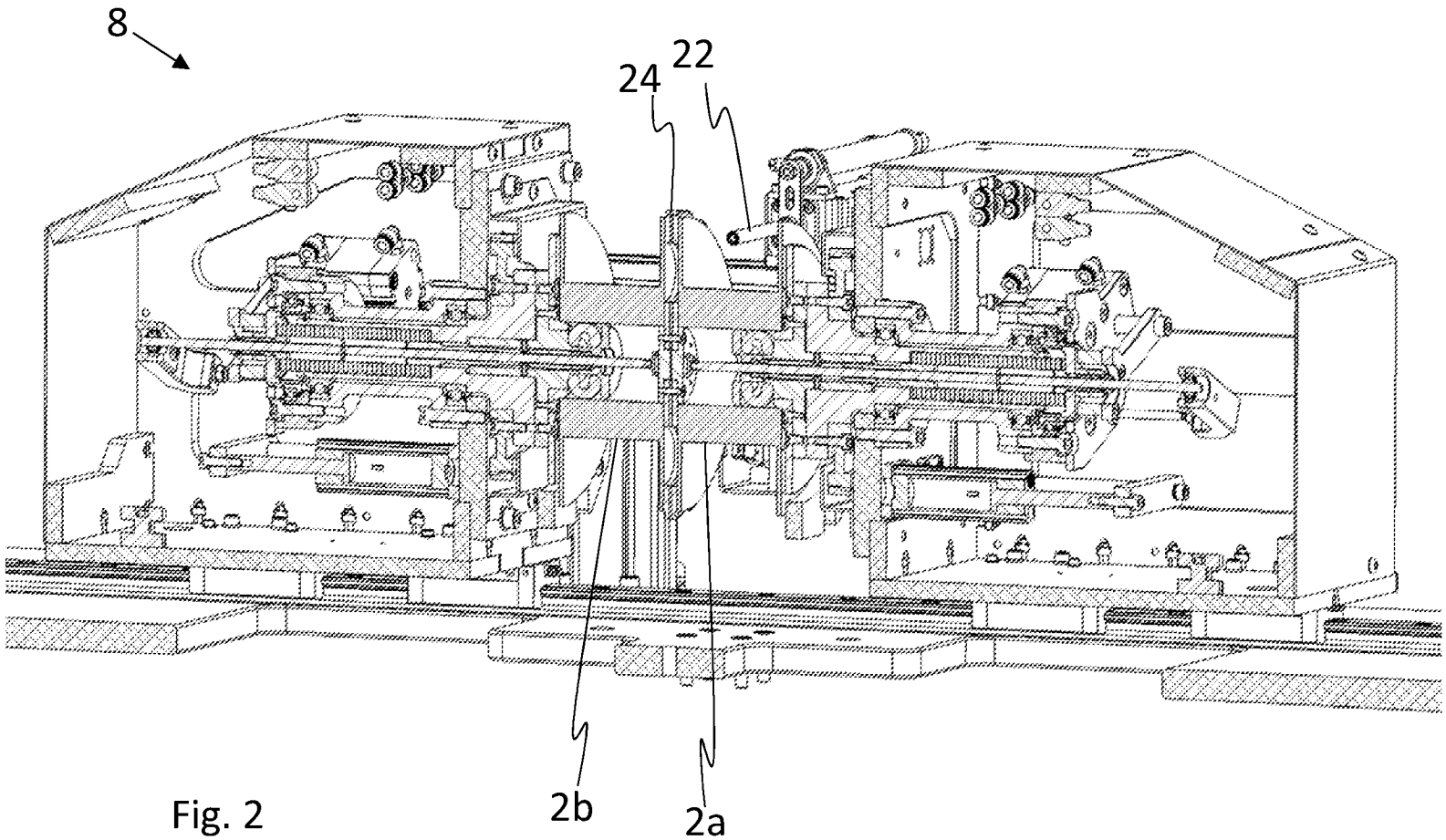
FIG. 2 illustrates a cross-sectional view of a part of the system.

Turning to FIG. 2, there is illustrated a cross-sectional view of a part of the system, more specifically the winding section 8. The system comprises a feeder 22 from which the continuous elongate element 4 (shown in FIGS. 8 and 9) may be provided to the cylindrical elements 2. The feeder 22 is here illustrated as having a tubular shape, such as a pipe, however, other configurations are also conceivable. The feeder 22 may suitably receive the continuous elongate element 4 from a suitable source. For instance, in the case of the continuous elongate element 4 being a plastic filament, the feeder 22 may receive it at the end of an extrusion equipment which forms and extrudes the filament. However, any other suitable means of supply to the feeder 22 may be provided.

In FIG. 2, there is illustrated a central rotatable member 24. An example of the configuration of the central rotatable member 24 will be later discussed in connection with FIG. 7. In FIG. 2, on either side of the central rotatable member 24 there has been provided a respective cylindrical element. For simplicity, in this discussion, the cylindrical element on the right hand side in the drawing will be referred to as a first cylindrical element 2*a*, and the cylindrical element on the left hand side will be referred to a as a second cylindrical element 2*b*. It should, of course, be understood that the herein assigned order numbers of the cylindrical elements are not bound to the left or the right side of the central rotatable member 24.

The feeder 22 is displacable such that it can be aligned with either one of the first cylindrical element 2*a* and the second cylindrical element 2*b*. For instance, if the feeder is aligned with the first cylindrical element 2*a* then the continuous elongate element 4 would be providable from the feeder 22 to the first cylindrical element 2*a*.

In order to operate the rotation of the cylindrical elements 2, 2*a*, 2*b* for winding the continuous elongate element 4 onto the cylindrical elements, a motor may suitably be provided on each side of the central rotatable member 24. Thus, a first motor 26*a* is provided for enabling rotation of the first cylindrical element 2*a* and a second motor 26*b* is provided for enabling rotation of the second cylindrical element 2*b* (see FIG. 10).

Figure 3:
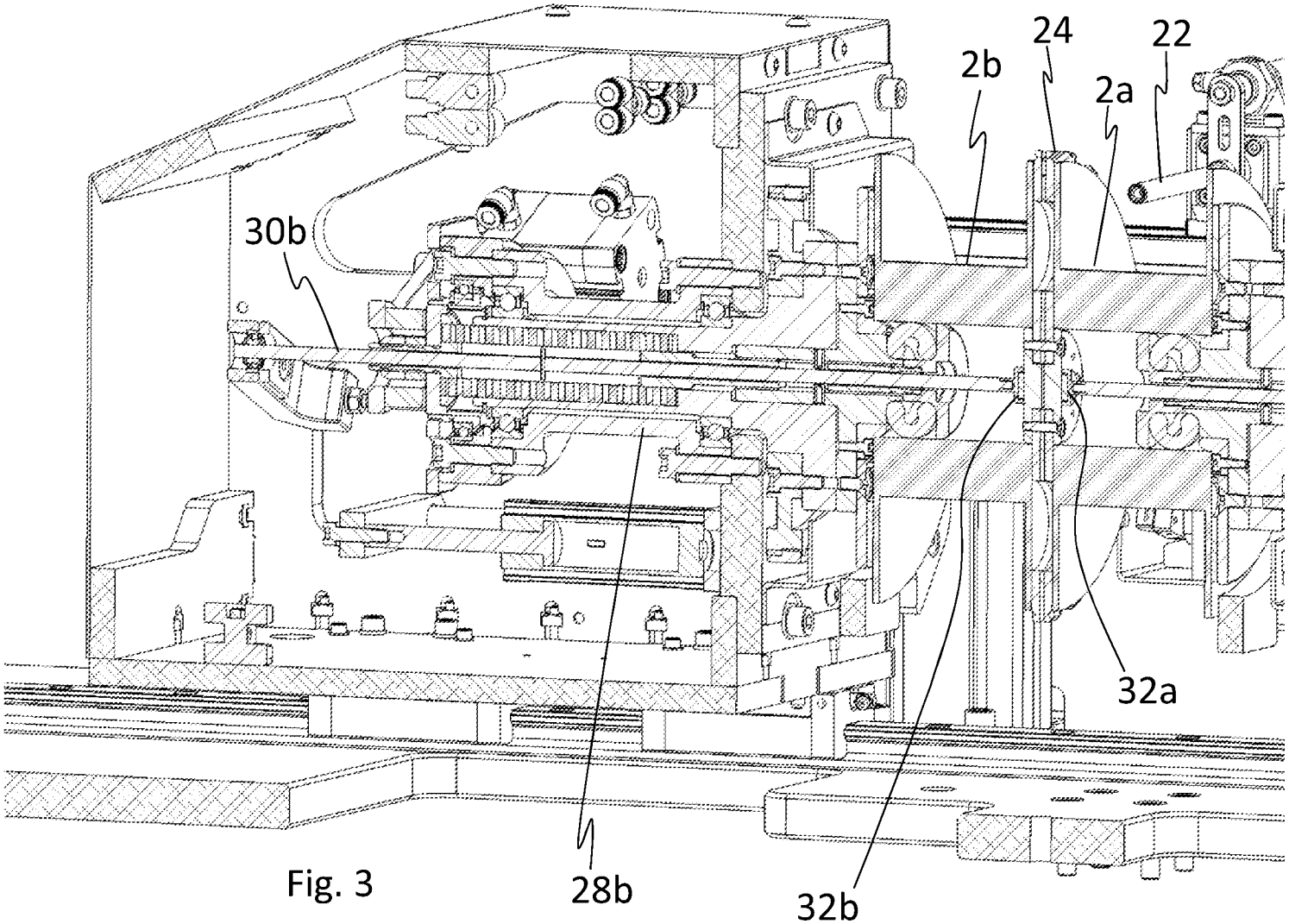
FIG. 3 is a close-up view of details in FIG. 2.
Figure 10:
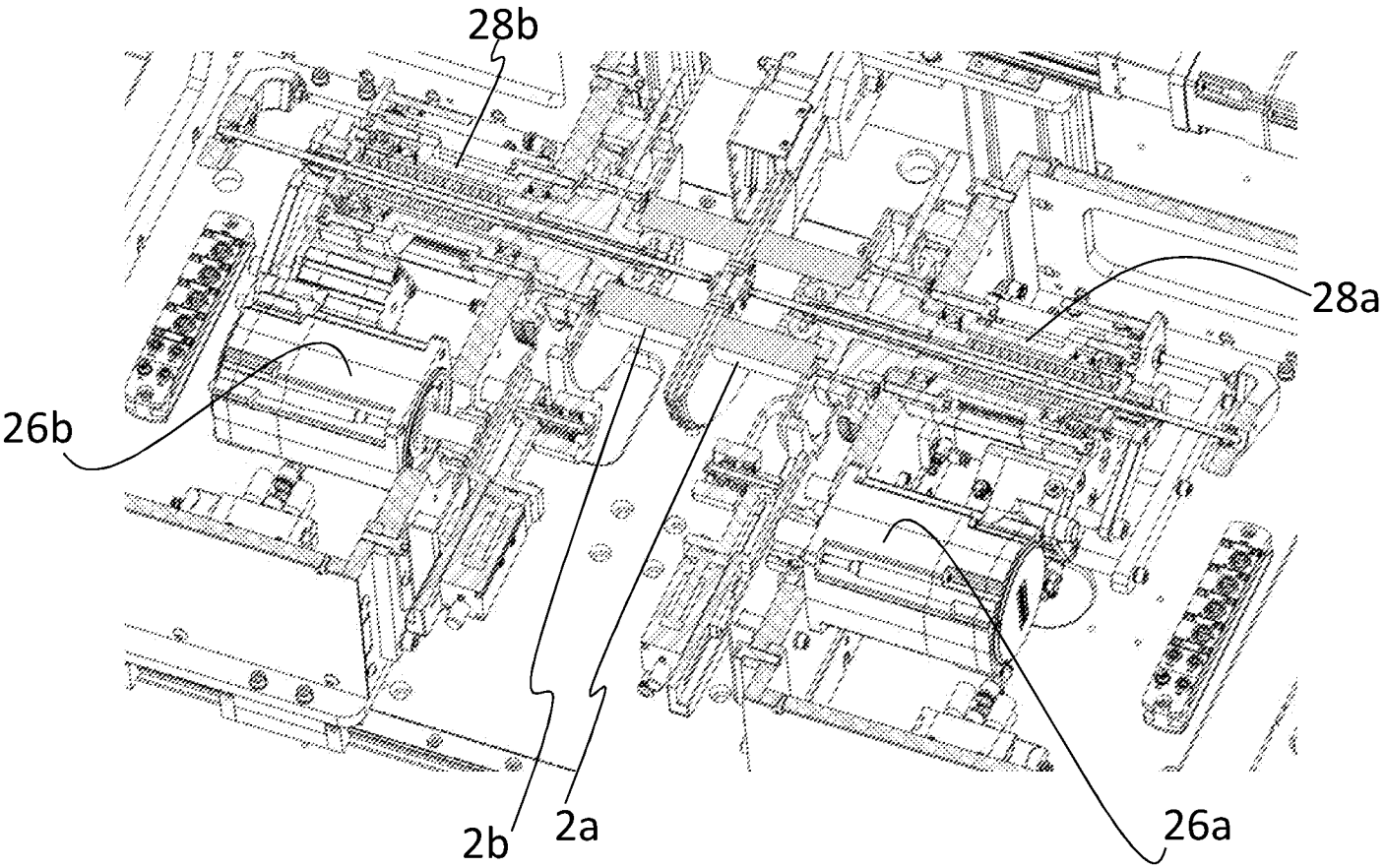
FIG. 10 is a cross-sectional view of a part of the system, the cross-section being in a horizontal plane.

Turning now to FIG. 3 and FIG. 10, it may be noted that FIG. 3 is a close-up view of details in FIG. 2. FIG. 10 is a cross-sectional view of a part of the system, taken in a horizontal plane, thus viewed from above. As regards FIG. 3, the details on the left side have been zoomed in, i.e. the details relating to components affecting the operation of the second cylindrical element 2*b*. It should be understood that, corresponding details are provided on the right side for affecting the operation of the first cylindrical element 2*a*. As can be seen in FIG. 10, the first motor 26*a* is configured to drive a first rotatable shaft 28*a* and the second motor 26*b* is configured to drive a second rotatable shaft 28*b*. As can be seen in FIG. 3, the second rotatable shaft 28*b* is configured to receive and hold a cylindrical element on the one side of the central rotatable member 24, i.e. in this case the second cylindrical element 2*b* (similarly, the first rotatable shaft 28*a* may hold the first cylindrical element 2*a* on the opposite side, as seen in FIG. 10). The control unit 20 (see FIG. 1) is configured to control the operation of the first motor 26*a* and the second motor 26*b*.

Each one of said rotatable shafts is provided with a respective spindle. Thus, with reference to FIG. 3, the second rotatable shaft 28*b* is illustrated as being provided with a second spindle 30*b* which is displaceable along the common geometrical rotational axis around which the cylindrical elements 2*a*, 2*b* and the central rotatable member 24 are configured to commonly rotate (similarly, the first rotatable shaft is provided with a displaceable first spindle). The second spindle 30*b* is provided with a second magnet 32*b*, here illustrated at an end of the second spindle 30*b* (similarly the first spindle is provided with a first magnet 32*a*, which can be seen in FIG. 3).

Figure 7:
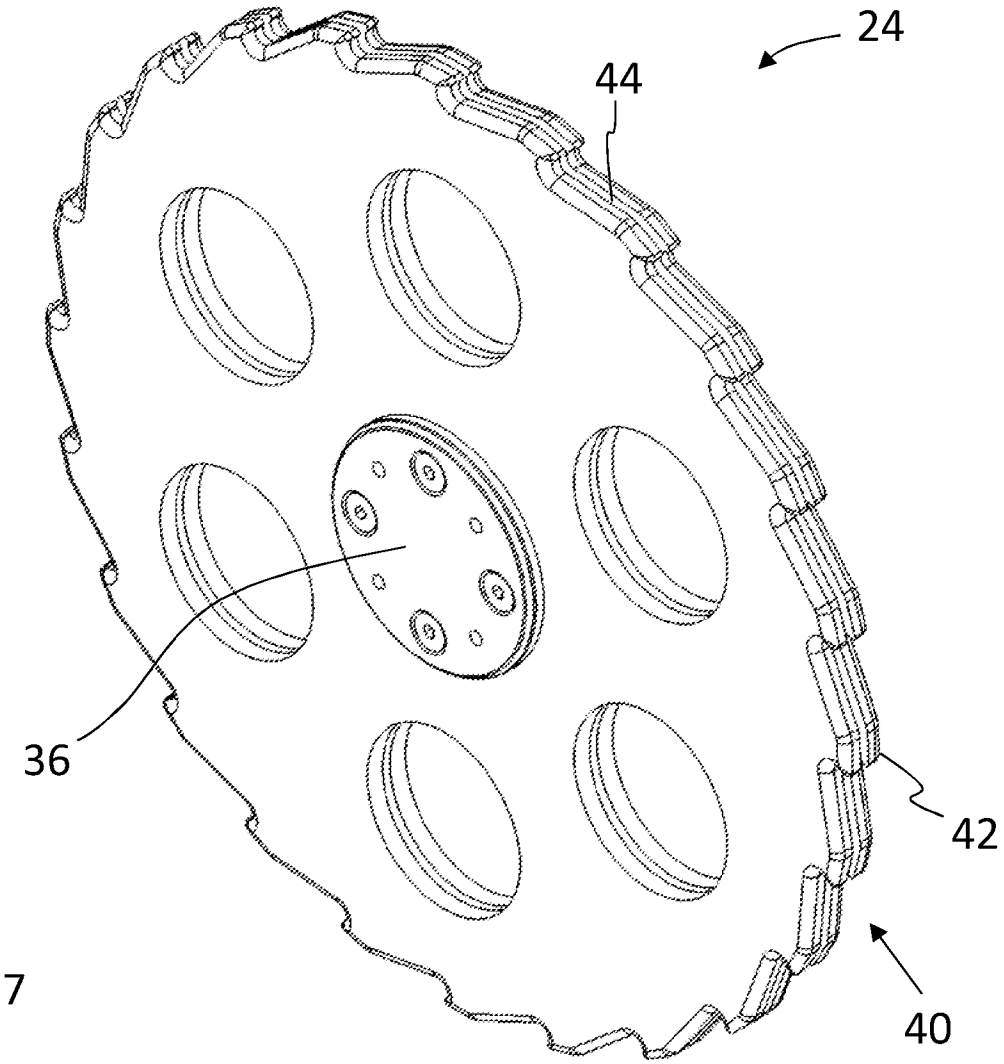
FIG. 7 illustrates a central rotatable member which may be used in a system according to at least some exemplary embodiments of the present invention.

As best seen in FIG. 7, the central rotatable member 24 may suitably be provided with one or more magnetic portions 36, suitably presenting a magnetic surface on both sides of the central rotatable member 24. The one or more magnetic portions 36 are provided for magnetically connecting the central rotatable member 24 to the first magnet 32*a* and the second magnet 32*b* to enable the central rotatable member 24 to rotate with the cylindrical elements 2*a*, 2*b* held by the first rotatable shaft and the second rotatable shaft 28*b*.

Thus, turning back to FIG. 3, although the second spindle 30*b* is displaceble in the axial direction relative to the part of the second rotatable shaft 28*b* which holds the second cylindrical element 2*b*, the second spindle 30*b* may suitably be configured to rotate with the second rotatable shaft 28*b* in order to enable the second cylindrical element 2*b* (driven by the second rotatable shaft 28*b*) and the central rotatable member 24 (connected to the second magnet 32*b*) to be rotated at the same speed. Corresponding relationship may, of course, suitably apply to the first rotatable shaft, the first spindle and the first magnet.

From the above, it can be understood that, in general terms, according to at least one exemplary embodiment, the first spindle and the second spindle are rotatably lockable to the first rotatable shaft and the second rotatable shaft, respectively. According to at least one exemplary embodiment, the first spindle and the second spindle are axially movably in a bore of the first rotatable shaft and the second rotatable shaft, respectively (as for example illustrated in the figures). According to at least one exemplary embodiment, the first spindle and the second spindle extend along the common geometrical axis (as for example seen in the figures).

When a cylindrical element is to be removed from the central rotatable member 24, then suitably the associated magnet 32*a* or 32*b* is first disconnected from the mating magnetic portion 36 of the central rotatable member 24. This is illustrated in for example FIGS. 4 and 5.

Figure 4:
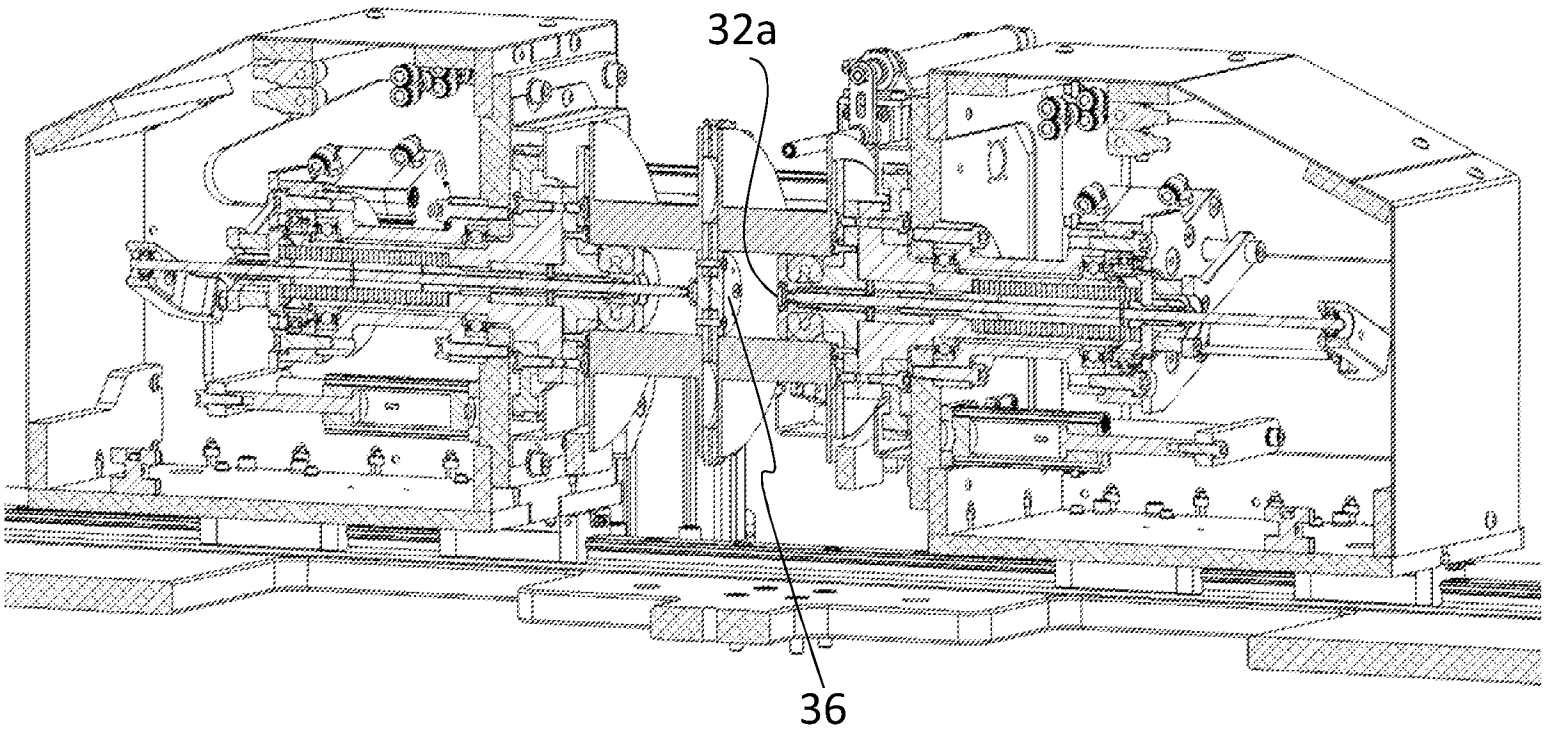
FIG. 4 illustrates, similarly to FIG. 2, a cross-sectional view of a part of the system, however, in a different state.
Figure 5:
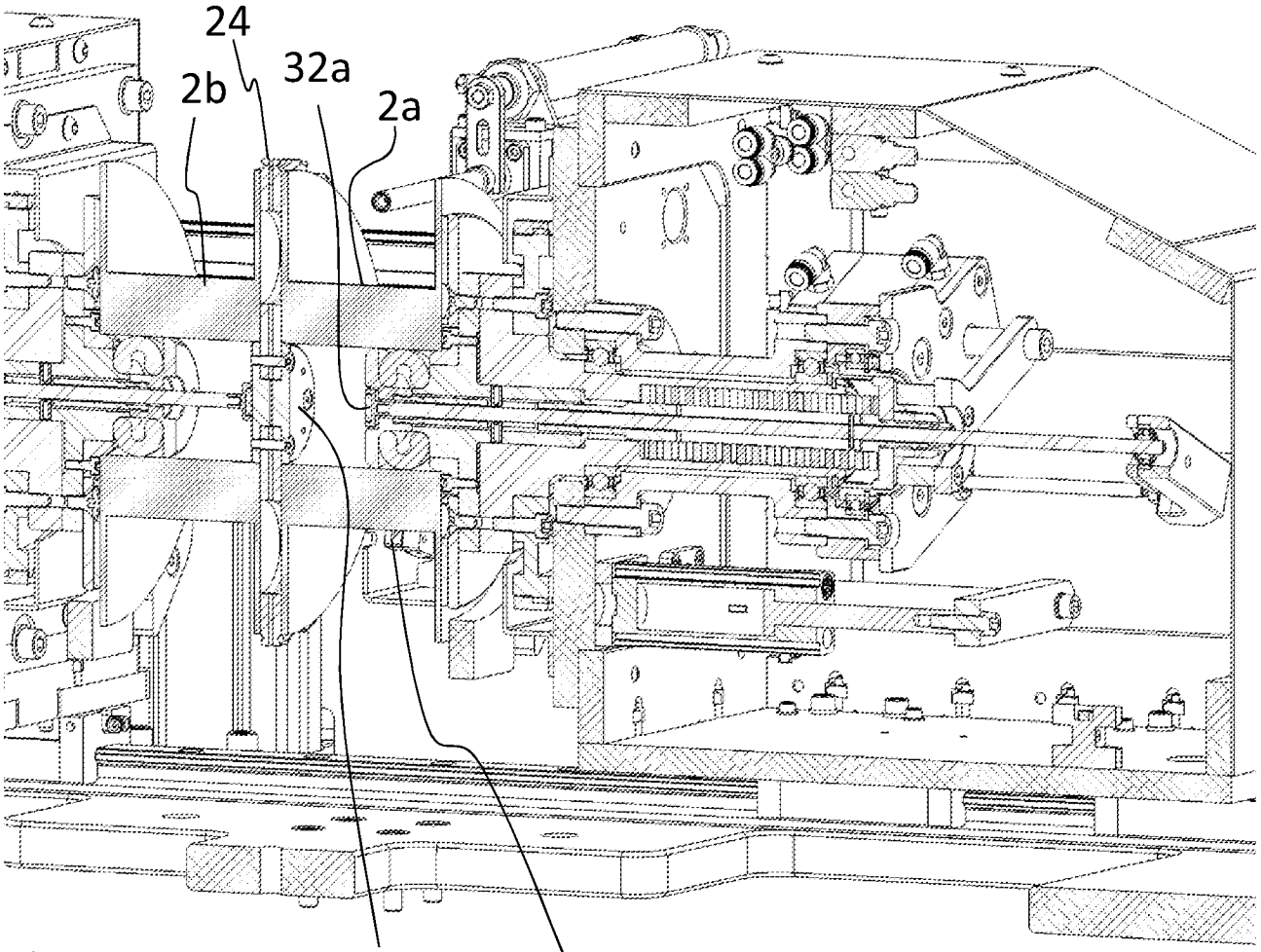
FIG. 5 is a close-up view of details in FIG. 4.

FIG. 4 illustrates, similarly to FIG. 2, a cross-sectional view of a part of the system, however, in a different state. FIG. 5 is a close-up view of details in FIG. 4. As best seen in FIG. 5, the first magnet has been disconnected from the magnetic portion 36 of the central rotatable member 24. This is normally done when the continuous elongate element has been wound onto the first cylindrical element 2*a*, and after a cutter 38 has cut the continuous elongate element. In FIG. 5, the cutter 38 is illustrated as comprising a blade, however, other means of cutting may be conceivable. Thus, the control unit 20 (FIG. 1) may be configured to do this disconnection action and also to axially remove the first cylindrical element 2*a* from the central rotatable member 24 which continues to rotate with the second cylindrical element 2*b*. The action of removal of the first cylindrical element 2*a* from the central rotatable member 24 is illustrated in FIG. 6.

Figure 6:
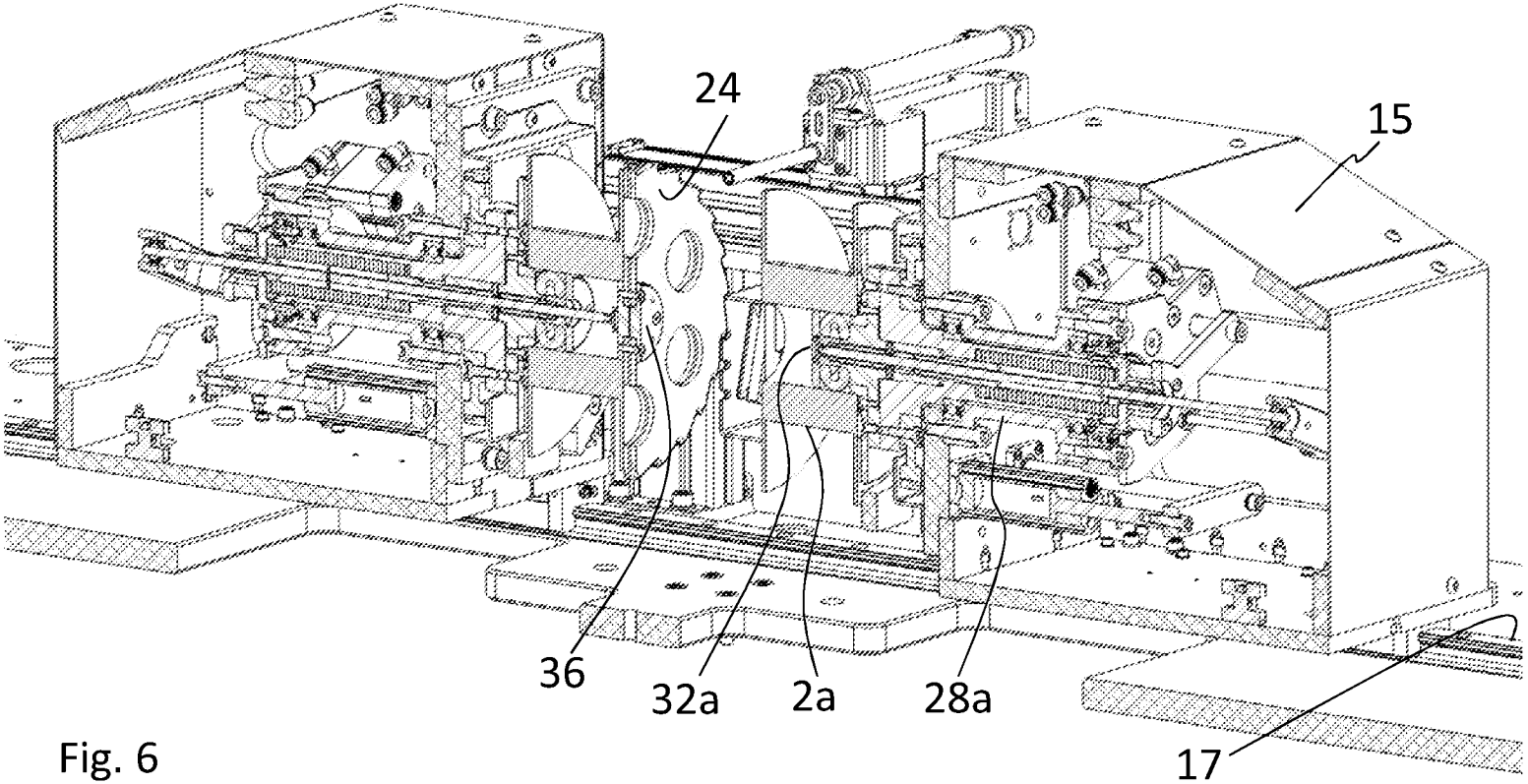
FIG. 6 illustrates, similarly to FIG. 2 and FIG. 4, a cross-sectional view of a part of the system, however in yet another state.

Thus, FIG. 6 illustrates, similarly to FIG. 2 and FIG. 4, a cross-sectional view of a part of the system, however now the first cylindrical element 2*a* has been removed by the first rotatable shaft 28*a* and the first magnet 32*a* has been disconnected from the magnetic portion 36 of the central rotatable member 24. In the illustrated embodiment, the shaft 28*a* is fixed in a head part 15. The head part 15 is movable along a track 17. The movement of the head part 15 may be accomplished by a suitable actuator (not shown). By moving the head part 15, the thereto fixed shaft 28*a* will follow. It should be understood that in other exemplary embodiments the rotatable shafts 28*a*, 28*b* may be arranged to be movable without fixing them to a respective head part 15 that is slidable along a track 17.

From the above, it can be understood that, in general terms, according to at least some exemplary embodiments, the first rotatable shaft and the second rotatable shaft are movable in the axial direction (in this disclosure axial direction refers to the direction of the common geometrical rotational axis) in order to selectively retract the respective cylindrical element from the central rotatable member or advance the respective cylindrical element towards the central rotatable member.

After the first cylindrical element 2*a* has been removed from the central rotatable member 24, it may be transferred to the post-winding section 10 (FIG. 1) of the system. A new cylindrical element may therefore be received from the pre-winding section 6 (FIG. 1). Thus, the control unit 20 may be configured to provide a third cylindrical element (for example from one of the stacks illustrated in FIG. 1) to the first rotatable shaft 28*a* so as to arrange the third cylindrical element at the previous winding position of the first cylindrical element 2*a*. Thus, the second cylindrical element and the third cylindrical element will then be located on respective sides of the central rotatable member 24 such that the second cylindrical element, the third cylindrical element and the central rotatable member 24 have the same geometrical rotational axis and rotate with the same rotational speed.

The control unit 20 is suitably configured to control the first and second motor 26*a*, 26*b* in master-slave-synchronization mode in which the slave is synchronized with the rotational speed of the master, wherein at any given point in time, the one of the first and second motors 26, 26*b* that is operating a cylindrical element onto which the continuous elongate element is currently being winded is the master, while the other one of the first and second motors is the slave.

FIG. 7 illustrates a central rotatable member 24 which may be used in a system according to at least some exemplary embodiments of the present invention. The central rotatable member 24 is here illustrated as a plate or a disc, however, as mentioned previously in this disclosure other configurations are also conceivable. FIG. 7 illustrates that the periphery of the of central rotatable member is provided with an engagement portion 40, here illustrated in the form of shark-fin-shaped protrusions 42. However, as discussed elsewhere in this disclosure the engagement portion 40 may be configured in other conceivable shapes. In the illustrated example, the central rotatable member 24 comprises a circular slit 44 extending along the periphery of the central rotatable member 24. The circular slit is 44 configured to receive the cutter 38 (FIG. 5) for enabling the cutter 38 to split the continuous elongate element into two portions. However, as discussed elsewhere in this disclosure, in other exemplary embodiments the continuous elongate element may be cut laterally of the central rotatable member 24 (i.e. at either side of the central rotatable member 24), in which case the central slit 44 may suitably be omitted.

Figure 8:
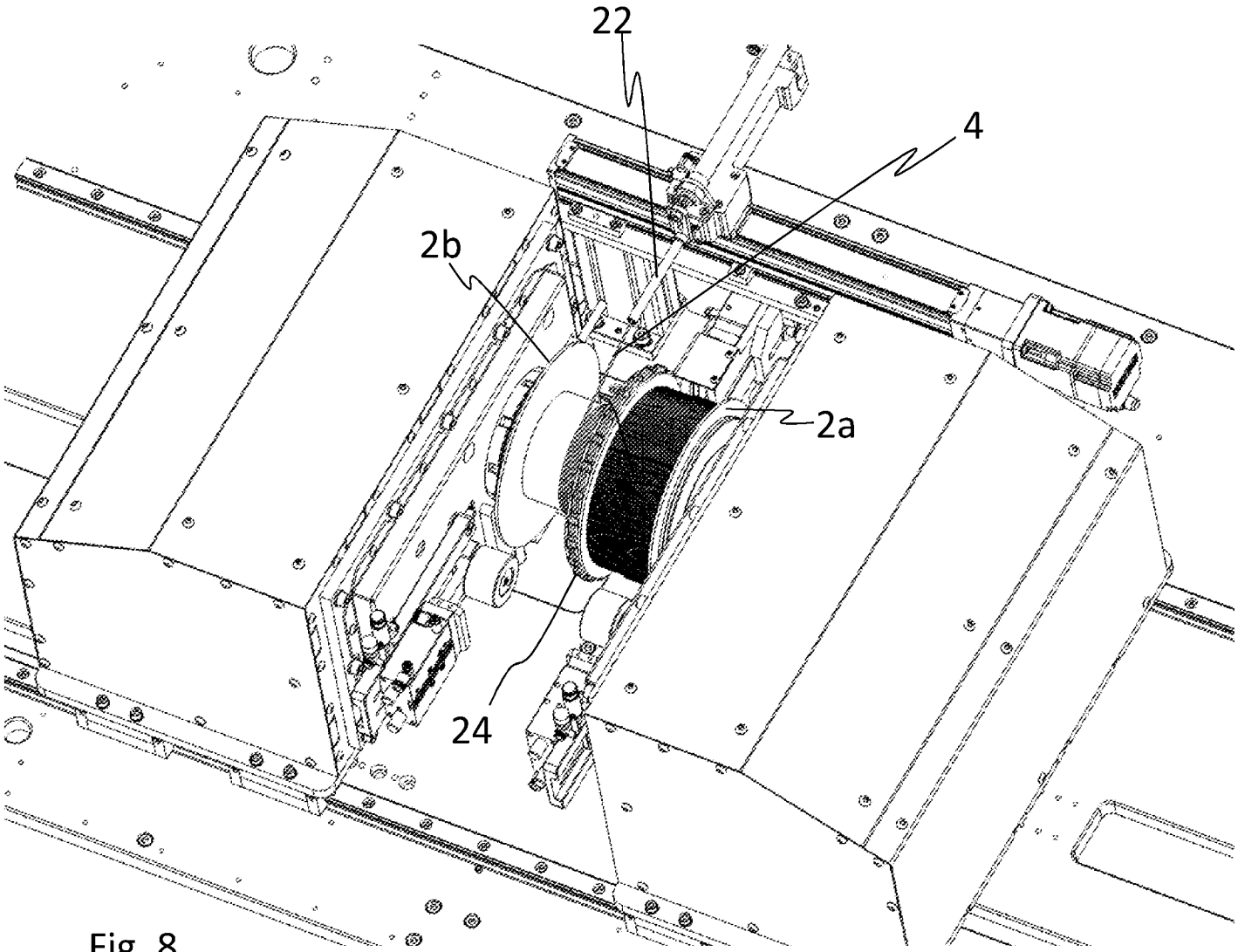
FIG. 8 illustrates the system winding a continuous elongate element onto cylindrical elements.
Figure 9:
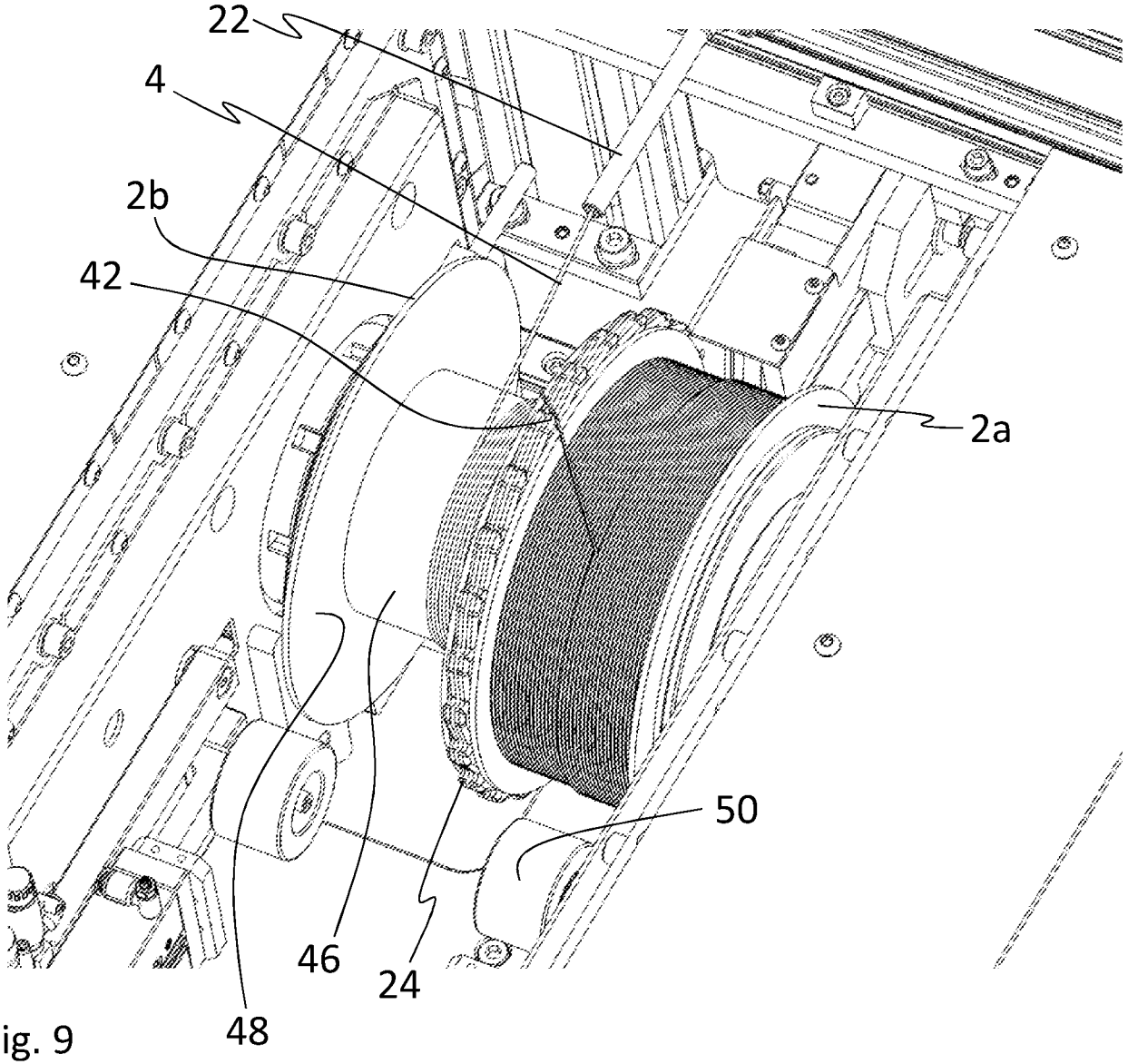
FIG. 9 is a close-up view of details of FIG. 8.

FIG. 8 illustrates the system winding a continuous elongate element onto cylindrical elements. FIG. 9 is a close-up view of details of FIG. 8. Thus, in the following, with reference to FIG. 8 and FIG. 9, the general inventive concept included in the present method and system will now be discussed.

As mentioned previously with reference to FIG. 1, the system 1 comprises a feeder 22 from which the continuous elongate element 4 may be provided to cylindrical elements 2 in consecutive order. The cylindrical elements 2 may thus be provided in the winding section 8 of the system 1 for receiving and winding the continuous elongate element 4 onto the cylindrical elements 2. In the case of the cylindrical elements being mandrels used for producing coils of the continuous elongate element 4, the same two mandrels may be reused over and over again, and thus the mandrels will alternatingly and repeatedly wind the continuous elongate element 4 (i.e. when one is fully wound, the coil is removed therefrom, while the empty one receives the continuous elongate element 4). In the current illustrations in FIG. 8 and FIG. 9, the cylindrical elements are in the form of spools. The first cylindrical element 2*a* has been fully winded, and the second cylindrical element 2*b* has started to receive the continuous elongate element 4. Thus, initially, the feeder 22 was aligned with the first cylindrical element 2*a*, but has in FIG. 8 and FIG. 9 been displaced to become aligned with the second cylindrical element 2*b*. The displacement of the feeder is controlled by the control unit 20 (FIG. 1). As best seen in FIG. 9 the continuous elongate element 4 has already been wound a few rotations/laps around a cylindrical winding portion 46 of the second cylindrical element 2*b*.

The control unit is configured to provide the first cylindrical element 2*a* and the second cylindrical element 2*b* on respective sides of the central rotatable member 24 along the common geometrical rotational axis. This may, for example, be achieved by means of rotatable shafts and spindles such as the ones previously discussed. The control unit is also configured to rotate the first cylindrical element 2*a*, the second cylindrical element 2*b* and the central rotatable member 24 with the same rotational speed. This may, for example, be achieved by means of motors, such as the ones previously discussed.

Accordingly, to achieve the situation illustrated in FIG. 8 and FIG. 9, the control unit 20 (FIG. 1) has first aligned the feeder 22 with the first cylindrical element 2*a*, thereby winding the continuous elongate element 4 onto the first cylindrical element 2*a* by rotating the first cylindrical element 2*a*. Thereafter, while the first cylindrical element 2*a*, the second cylindrical element 2*b* and the central rotatable member 24 rotate, the control unit 20 has caused the feeder 22 to be displaced from being aligned with the first cylindrical element 2*a* to being aligned with the second cylindrical element 2*b*. It should be understood that once it is aligned with the second cylindrical element 2*b*, the feeder 22 may suitably move slightly back and forth in parallel with the geometrical rotational axis in order to better distribute the laying out of the continuous elongate element 4 over the cylindrical winding surface 46 of the second cylindrical element 2*b*. The displacement of the feeder 22 from the first cylindrical element 2*a* to the second cylindrical element 2*b* causes the continuous elongate element 4 to come into engagement with the engagement portion of the central rotatable member 24. As best seen in FIG. 9, one of the protrusions 42 of the engagement portion has engaged with the continuous elongate element 4. The protrusions 42 present abutment surfaces for catching the continuous elongate element 4 as the feeder 22 is moved from being aligned with the first cylindrical element 2*a* to being aligned with the second cylindrical element 2*b* (or vice versa).

After this engagement has occurred, the control unit 20 continues to rotate the second cylindrical element 2*b* for winding the continuous elongate element 4 from the feeder 22 onto the second cylindrical element 2*b*. Suitably the first cylindrical element 2*a* and the central rotatable member 24 continuous to rotate with the second cylindrical element 2*b* for a sufficient number of rotations until the winding of the continuous elongate element 4 on the second cylindrical element 2*b* has become self-locking.

As best seen in FIG. 9, the diameter of the central rotatable member 24 is suitably larger than the diameter of the cylindrical elements 2*a*, 2*b*. Thus, the radial distance between the common geometrical rotational axis and the engagement portion is larger than the radial distance between the common geometrical axis and a circumference of end wall portions 48 of the cylindrical elements 2*a*, 2*b*. This is beneficial as it counteracts unwinding from the first cylindrical element 2*a* when it rotates with the second cylindrical element 2*b* after the switch (displacement of the feeder 22 to the second cylindrical element 2*b*) has been made.

When the continuous elongate element 4 has been sufficiently secured (self-locked) to the second cylindrical element 2*b*, it may be cut by the cutter (shown in FIG. 5) so that the first cylindrical element 2*a* with its winding may be removed for further handling (e.g. transferring to the post-winding section). Thus, at this stage, as previously discussed in relation to FIG. 6, the first magnet 32*a* may be disconnected from the magnetic portion 36 of the central rotatable member 24 and the first rotatable shaft 28*a* may be retracted to remove the first cylindrical element 2*a* from the central rotatable member 24, which continues to rotate with the second cylindrical element 2*b*.

With reference again to FIG. 9, the control unit may suitably be configured to apply a roller 50 against the already winded portion of the continuous elongate element 4 before the continuous elongate element is cut, and the roller 50 may suitably be kept against the already winded portion after the continuous elongate element 4 has been cut, until the first cylindrical element 2*a* has decelerated sufficiently (thereby reducing the risk of the already winded portion unwinding after the cutting).

The control unit may thus suitably be configured to control the cutter 38 (FIG. 5) to cut the continuous elongate element 4 at its engagement with the engagement portion so as to split it into two portions, a first portion already wound on the first cylindrical element 2*a* and a second portion which is still being winded onto the second cylindrical element 2*b*.

The method of the present inventive concept may suitably be performed by the control unit 20. Thus, the above steps, actions, operations, etc. performed by the control unit 20 may suitably be included in the method of the present invention, including exemplary embodiments thereof.

The invention claimed is:

1. A system for winding a continuous elongate element onto cylindrical elements, the system comprising:

a feeder from which the continuous elongate element is providable to cylindrical elements in consecutive order, a plurality of cylindrical elements for receiving and winding said continuous elongate element, a central rotatable member provided with an engagement portion, a cutter comprising: a first motor configured to drive a first rotatable shaft, the first rotatable shaft being configured to receive and hold a cylindrical element on one side of the central rotatable member, and a second motor configured to drive a second rotatable shaft, the second rotatable shaft being configured to receive and hold a cylindrical element on the opposite side of the central rotatable member; and a control unit, wherein the control unit is configured to:

align the feeder with a first cylindrical element of said plurality of cylindrical elements for winding the continuous elongate element onto the first cylindrical element by rotating the first cylindrical element, provide the first cylindrical element and a second cylindrical element of said plurality of cylindrical elements on respective sides of the central rotatable member along a common geometrical rotational axis, rotate the first cylindrical element, the second cylindrical element and the central rotatable member with the same rotational speed, while the first cylindrical element, the second cylindrical element and the central rotatable member rotate, cause the feeder to be displaced from being aligned with the first cylindrical element to being aligned with the second cylindrical element, wherein the displacement causes the continuous elongate element to come into engagement with the engagement portion of the central rotatable member, preventing the already wound portion of the continuous elongate element from being unwound from the first cylindrical element, and continue to rotate the second cylindrical element for winding the continuous elongate element from the feeder onto the second cylindrical element; and wherein the control unit is further configured to:

control the cutter to cut the continuous elongate element at its engagement with the engagement portion so as to split it into two portions, a first portion already wound on the first cylindrical element and a second portion which is still being winded onto the second cylindrical element, and control the operation of the first and second motor of the cutter in master-slave-synchronization mode in which the slave is synchronized with the rotational speed of the master, wherein at any given point in time, the one of the first and second motors that is operating a cylindrical element onto which the continuous elongate element is currently being winded is the master, while the other one of the first and second motors is the slave.

2. The system as claimed in claim 1, wherein the control unit is configured to receive input parameter values relating to dimensions of an individual cylindrical element of said plurality of cylindrical elements and/or relating to dimensions of the continuous elongate element, wherein the control unit is configured to, based on the received input parameter values, determine when to switch the winding of the continuous elongate element from the first cylindrical element to the second cylindrical element.

3. The system as claimed in claim 1, wherein each cylindrical element comprises a cylindrical winding portion delimited by a wall portion at each end of the cylindrical winding portion, wherein, when the first cylindrical element, the second cylindrical element and the central rotatable member rotate around the common geometrical rotational axis, the radial distance between the common geometrical rotational axis and the engagement portion is larger than the radial distance between the common geometrical rotational axis and a circumference of said wall portions of the first and second cylindrical elements.

4. The system as claimed in claim 1, wherein the engagement portion of the central rotatable member comprises a plurality of protrusions, wherein the plurality of protrusions present abutment surfaces for catching the continuous elongate element as the feeder is moved from being aligned with the first cylindrical element to being aligned with the second cylindrical element.

5. The system as claimed in claim 1, wherein the central rotatable member comprises a circular slit extending along the periphery of the central rotatable member, wherein the circular slit is configured to receive the cutter for enabling the cutter to split the continuous elongate element into two portions.

6. The system as claimed in claim 1, wherein the first rotatable shaft is provided with a first spindle which is displaceable along said geometrical rotational axis, the first spindle being provided with a first magnet, wherein the second rotatable shaft is provided with a second spindle which is displaceable along said geometrical rotational axis, the second spindle is provided with a second magnet, wherein the central rotatable member is provided with one or more magnetic portions, for magnetically connecting the central rotatable member to the first magnet and the second magnet to enable the central rotatable member to rotate with cylindrical elements held by the first and second rotatable shafts.

7. The system as claimed in claim 6, wherein after the cutter has cut the continuous elongate element, the control unit is configured to disconnect the first magnet from said one or more magnetic portions of the central rotatable member and axially remove the first cylindrical element from the central rotatable member which continues to rotate with the second cylindrical element.

8. The system as claimed in claim 7, wherein the control unit is configured to provide a third cylindrical element to the first rotatable shaft to arrange the third cylindrical element at the previous winding position of the first cylindrical element, so that the second cylindrical element and the third cylindrical element are located on respective sides of the central rotatable member such that the second cylindrical element, the third cylindrical element and the central rotatable member have the same geometrical rotational axis and rotate with the same rotational speed.

9. A system for winding a continuous elongate element onto cylindrical elements, the system comprising:

a feeder from which the continuous elongate element is providable to cylindrical elements in consecutive order, a plurality of cylindrical elements for receiving and winding said continuous elongate element, a central rotatable member provided with an engagement portion, a cutter, at least one roller, and a control unit, wherein the control unit is configured to:

align the feeder with a first cylindrical element of said plurality of cylindrical elements for winding the continuous elongate element onto the first cylindrical element by rotating the first cylindrical element, provide the first cylindrical element and a second cylindrical element of said plurality of cylindrical elements on respective sides of the central rotatable member along a common geometrical rotational axis, rotate the first cylindrical element, the second cylindrical element and the central rotatable member with the same rotational speed, while the first cylindrical element, the second cylindrical element and the central rotatable member rotate, cause the feeder to be displaced from being aligned with the first cylindrical element to being aligned with the second cylindrical element, wherein the displacement causes the continuous elongate element to come into engagement with the engagement portion of the central rotatable member, preventing the already wound portion of the continuous elongate element from being unwound from the first cylindrical element, and continue to rotate the second cylindrical element for winding the continuous elongate element from the feeder onto the second cylindrical element; and wherein the control unit is further configured to:

control the cutter to cut the continuous elongate element at its engagement with the engagement portion so as to split it into two portions, a first portion already wound on the first cylindrical element and a second portion which is still being winded onto the second cylindrical element, and apply the at least one roller against the already winded portion of the continuous elongate element before the cutter cuts the continuous elongate element.

10. The system as claimed in claim 9, wherein each cylindrical element comprises a cylindrical winding portion delimited by a wall portion at each end of the cylindrical winding portion, wherein, when the first cylindrical element, the second cylindrical element and the central rotatable member rotate around the common geometrical rotational axis, the radial distance between the common geometrical rotational axis and the engagement portion is larger than the radial distance between the common geometrical rotational axis and a circumference of said wall portions of the first and second cylindrical elements.

11. The system as claimed in claim 9, wherein the engagement portion of the central rotatable member comprises a plurality of protrusions, wherein the plurality of protrusions present abutment surfaces for catching the continuous elongate element as the feeder is moved from being aligned with the first cylindrical element to being aligned with the second cylindrical element.

12. The system as claimed in claim 9, wherein the central rotatable member comprises a circular slit extending along the periphery of the central rotatable member, wherein the circular slit is configured to receive the cutter for enabling the cutter to split the continuous elongate element into two portions.

13. The system as claimed in claim 9, wherein the control unit is configured to receive input parameter values relating to dimensions of an individual cylindrical element of said plurality of cylindrical elements and/or relating to dimensions of the continuous elongate element, wherein the control unit is configured to, based on the received input parameter values, determine when to switch the winding of the continuous elongate element from the first cylindrical element to the second cylindrical element.

* * * * *